US005508153A

United States Patent [19]

Ishikawa et al.

[11] Patent Number: 5,508,153

[45] Date of Patent: Apr. 16, 1996

[54] COMPOSITION FOR DEVELOPING A BLACK-AND-WHITE SILVER HALIDE PHOTOGRAPHIC LIGHT-SENSITIVE MATERIAL

[75] Inventors: Wataru Ishikawa; Takeshi Sanpei; Mariko Kato, all of Hino, Japan

[73] Assignee: Konica Corporation, Japan

[21] Appl. No.: 380,147

[22] Filed: Jan. 27, 1995

Related U.S. Application Data

[63] Continuation of Ser. No. 159,847, Dec. 1, 1993, abandoned.

[30] Foreign Application Priority Data

| | | | |
|---|---|---|---|
| Dec. 9, 1992 | [JP] | Japan | 4-329601 |
| Dec. 22, 1992 | [JP] | Japan | 4-342765 |
| Mar. 5, 1993 | [JP] | Japan | 5-045345 |

[51] Int. Cl.[6] ..... G03C 5/18; G03C 5/26; G03C 1/06

[52] U.S. Cl. ..... 430/445; 430/488; 430/489; 430/490; 430/491; 430/493; 430/264; 430/963

[58] Field of Search ..... 430/445, 488, 430/489, 490, 491, 493, 603, 611, 963, 264

[56] References Cited

U.S. PATENT DOCUMENTS

| | | | |
|---|---|---|---|
| 2,933,388 | 4/1960 | Knott | 430/445 |
| 2,956,876 | 10/1960 | Spath | 430/489 |
| 3,161,515 | 12/1964 | Welsh | 430/445 |
| 3,244,521 | 4/1966 | Dersch et al. | 430/611 |
| 3,695,880 | 10/1972 | Kabbe et al. | 430/367 |
| 3,741,765 | 6/1973 | Iwano et al. | 430/383 |
| 3,782,945 | 1/1974 | Shimamura et al. | 430/490 |
| 4,169,733 | 10/1979 | Iyataka et al. | 96/50 |
| 4,604,339 | 8/1986 | Sugimoto et al. | 430/244 |
| 4,871,653 | 10/1989 | Inoue et al. | 430/409 |
| 5,158,856 | 10/1992 | Usagawa et al. | 430/264 |
| 5,244,773 | 9/1993 | Muramatsu et al. | 430/598 |

FOREIGN PATENT DOCUMENTS

| | | | |
|---|---|---|---|
| 507284 | 10/1992 | European Pat. Off. . | |
| 374572 | 11/1973 | U.S.S.R. | 430/445 |
| 701054 | 12/1953 | United Kingdom | 430/489 |
| 1401112 | 7/1975 | United Kingdom . | |

*Primary Examiner*—Charles L. Bowers, Jr.
*Assistant Examiner*—J. Pasterczyk
*Attorney, Agent, or Firm*—Jordan B. Bierman; Bierman and Muserlian

[57] ABSTRACT

A method for processing an imagewise exposed black-and-white negative silver halide photographic light-sensitive material comprising a support having provided thereon photographic layers including at least one silver halide emulsion layer, one of said photographic layers containing a hydrazine derivative, said method comprising;

developing said light-sensitive material with a developer comprising a black and white developing agent and a compound represented by Formula VI, said developer having a pH of less than 11.5;

(VI)

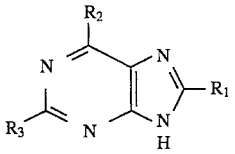

wherein $R_1$, $R_2$, and $R_3$ are each independently hydrogen, —$SM_1$, hydroxyl, alkoxyl having 1 to 5 carbon atoms, —$COOM_2$, amino, alkyl having 1 to 5 carbon atoms, provided that at least one of $R_1$, $R_2$, and $R_3$ is —$SM_1$, and $M_1$ and $M_2$ are each independently hydrogen, alkali metal, or ammonium.

19 Claims, No Drawings

COMPOSITION FOR DEVELOPING A BLACK-AND-WHITE SILVER HALIDE PHOTOGRAPHIC LIGHT-SENSITIVE MATERIAL

This application is a continuation of application Ser. No. 08/159,847, filed Dec. 1, 1993, now abandoned.

FIELD OF THE INVENTION

This invention relates to the composition for developing a black-and-white silver halide photographic light-sensitive material, particularly to the composition for developing a black-and-white silver halide photographic light-sensitive material, wherein a high contrast can be provided and silver sludge production can be inhibited.

BACKGROUND OF THE INVENTION

In general, a black-and-white silver halide photographic light-sensitive material is exposed to light imagewise and is then photographically processed in a process comprising 4 steps, namely, a developing step, a fixing step, a washing step and a drying step. Most of the developing steps are carried out with a developing solution comprising hydroquinone and phenidone or metol in combination. It is usual to contain a sulfite in the developing solution for preventing any oxidation of a developing agent and improving the preservability of the developing solution, because the developing step is carried out in an alkaline condition. However, the sulfite has a nature of dissolving a silver salt. Therefore, a silver salt is dissolved out of a photographic light-sensitive material in the course of carrying out a developing step. The silver salt dissolved in the developing solution is reduced and deposited to become a metal silver. The deposited metal silver then adheres to the surface of the light-sensitive material, so that a silver stain may be produced. Particularly in a high-temperature and rapid process carried out through an automatic processor, such a silver stain as mentioned above becomes problematic.

When an amount of a developing solution replenished is relatively smaller to a quantity of light-sensitive materials processed, the above-mentioned problem becomes more serious, because a deposited concentration of the metal silver is relatively increased. For solving the problem, some research on a compound have been so tried to improve a preservability without dissolving such a silver salt as mentioned above. However, no answer thereto has still been discovered. On the other hand, some research have also been tried on how to prevent any deposition by trapping a silver salt being dissolved. For example, a silver sludge preventive has widely been searched to obtain so far. U.S. Pat. No. 3,173,789 reports on a 1-phenyl-5-mercaptotetrazole derivative; Japanese Patent Publication Open to Public Inspection (hereinafter abbreviated to JP OPI Publication) No. 52-36029/1977, a disulfide compound; and JP Examined Publication No. 62-4702/1987, a 2-mercaptobenzimidazole derivative; respectively. However, in any method in which the above-mentioned substances are used, there have raised such an additional problem that a developing speed is slowed down, that a fixing speed is also slowed down because a developing solution is brought into a fixing solution in the next step, and/or that the function of a silver sludge preventive is put out because it is reacted with a developing solution being preserved for a long time.

SUMMARY OF THE INVENTION

This invention is to solve the above-mentioned problems. It is, therefore, an object of the invention to provide a composition for developing a black-and-white silver halide photographic light-sensitive material, by which any silver stain cannot be produced.

Another object of the invention is to provide a composition for developing a black-and-white silver halide photographic light-sensitive material, by which any fixability cannot be spoiled.

A further object of the invention is to provide a composition of a solution for developing a black-and-white silver halide photographic light-sensitive material, by which an excellent rapid processability can be obtained.

A still further object of the invention is to provide a stable composition for developing a black-and-white silver halide photographic light-sensitive material.

A composition of a developing solution of the invention contains a compound represented by the following Formulas I through VIII, and the pH thereof is to be-lower than 11.5.

Formula I

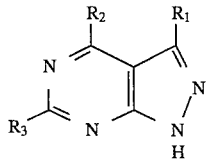

Formula V

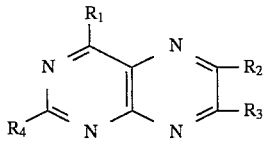

In the above Formula I to V, $R_1$, $R_2$, $R_3$ and R4 are each represent a hydrogen atom, a halogen atom, an —$SM_1$ group, a lower alkyl group, such as a methyl group and an ethyl group, a lower alkoxy group, a hydroxy group, an —$SO_3M_3$ group, a lower alkenyl group, an amino group, a $COOM_2$ group, a carbamoyl group, and a phenyl group; provided, at least one of $R_1$, $R_2$ and $R_3$ in Formula I, $R_1$, $R_2$, $R_3$ and $R_4$ in Formula II and V, and $R_1$ and R2 in Formulas III and IV is a —$SM_1$ group. Particularly, a water-solubilizing group such as a hydroxy group, a $COOM_2$ group, an amino group and a sulfo group are preferable to be a substituent other than a —$SM_1$ group; and $M_1$, $M_2$ and $M_3$ represent each a hydrogen atom, an alkali-metal atom or an ammonium group.

Formula VI

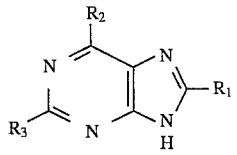

In Formula VI, $R_1$, $R_2$ and $R_3$ represent each a hydrogen atom, a —$SM_1$ group, a hydroxy group, a lower alkoxy group, a —$COOM_2$ group, an amino group, an —$SO_3M_3$ group or a lower alkyl group; provided, at least one of $R_1$, $R_2$ and $R_3$ represents an —$SM_1$ group; and $M_1$, $M_2$ and $M_3$ represent each a hydrogen atom, an alkali-metal atom or an ammonium group, provided, $M_1$, $M_2$ and $M_3$ may also be the same with or the different from each other.

Formula VII

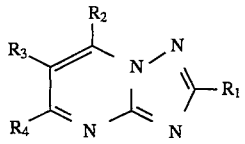

Formula VIII

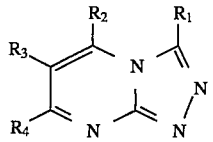

In Formulas VII and VIII, $R_1$, $R_2$, $R_3$ and $R_4$ represent each a hydrogen atom, a —$SM_1$ group, a hydroxy group, a lower alkoxy group, a —$COOM_2$ group, an amino group, an —$SO_3M_3$ group or a lower alkyl group; provided, at least one of $R_1$, $R_2$, $R_3$ and $R_4$ represents an —$SM_1$ group; and $M_1$, $M_2$ and $M_3$ represent each a hydrogen atom, an alkali-metal atom or an ammonium group, provided, $M_1$, $M_2$ and $M_3$ may also be the same with or the different from each other.

In the above-given Formulas I through VIII, a lower alkyl group and a lower alkoxy group each represented by $R_1$, $R_2$, $R_3$ and $R_4$ are each a group having 1 to 5 carbon atoms and preferably 1 to 3 carbon atoms and a lower alkenyl group represented by $R_1$, $R_2$, $R_3$ and $R_4$ are each a group having 2 to 5 carbon atoms. The alkyl, alkoxy and alkenyl group each may have a substituent. An amino group represented by $R_1$, $R_2$, $R_3$ and $R_4$ include an substituted or unsubstituted amino group. The preferable substituents thereto include, for example, a lower alkyl group.

In the above-given Formulas [I] through [VIII], the ammonium group is a substituted or unsubstituted ammonium group and, preferably, an unsubstituted ammonium group.

DETAILED DESCRIPTION OF THE INVENTION

Some typical examples of the compounds represented by Formulas I through VIII will now be given below, in which compounds of Formula VI is classified to Formulas VIa to VIc according to the position of —SH group.

Formula I

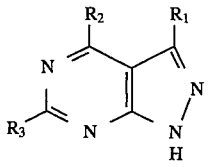

| | $R_1$ | $R_2$ | $R_3$ |
|---|---|---|---|
| I-1 | H | H | SH |
| I-2 | H | SH | H |
| I-3 | $CH_3$ | H | SH |
| I-4 | OH | H | SH |
| I-5 | H | $NH_2$ | SH |
| I-6 | Cl | SH | H |
| I-7 | COOH | H | SH |

Formula II

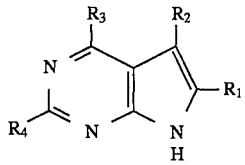

| | $R_1$ | $R_2$ | $R_3$ | $R_4$ |
|---|---|---|---|---|
| II-1 | H | H | H | SH |
| II-2 | Cl | H | H | SH |
| II-3 | SH | H | H | H |
| II-4 | $nC_5H_{11}$ | H | H | SH |
| II-5 | OH | H | H | SH |
| II-6 | H | H | OH | SH |
| II-7 | SH | H | SH | H |

Formula III

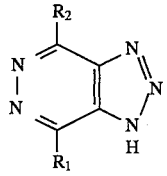

| | $R_1$ | $R_2$ |
|---|---|---|
| III-1 | SH | H |
| III-2 | SH | SH |
| III-3 | SH | COOH |
| III-4 | SH | $SO_3H$ |
| III-5 | SH | OH |

Formula IV

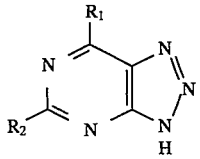

| | $R_1$ | $R_2$ |
|---|---|---|
| IV-1 | SH | H |
| IV-2 | SH | SH |
| IV-3 | SH | COOH |
| IV-4 | SH | $SO_3H$ |
| IV-5 | SH | OH |

Formula V

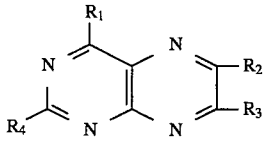

| | $R_1$ | $R_2$ | $R_3$ | $R_4$ |
|---|---|---|---|---|
| V-1 | H | H | H | SH |
| V-2 | H | H | SH | SH |
| V-3 | OH | H | H | SH |
| V-4 | H | $C_5H_{11}$ | H | SH |
| V-5 | SH | COOH | H | H |

-continued

Formula V

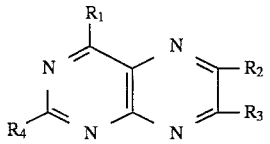

| | $R_1$ | $R_2$ | $R_3$ | $R_4$ |
|---|---|---|---|---|
| V-6 | H | H | $SO_3H$ | SH |

Formula VIa

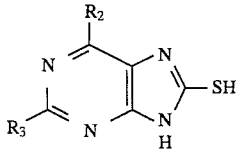

| | $R_2$ | $R_3$ |
|---|---|---|
| VIa-1 | H | H |
| VIa-2 | −OH | H |
| VIa-3 | H | −OH |
| VIa-4 | −SH | H |
| VIa-5 | H | −SH |
| VIa-6 | $-NH_2$ | H |
| VIa-7 | H | $-NH_2$ |
| VIa-8 | −OH | −OH |
| VIa-9 | $-NH_2$ | $-NH_2$ |
| VIa-10 | −SH | −SH |
| VIa-11 | $-CH_3$ | H |
| VIa-12 | H | $-CH_3$ |
| VIa-13 | $-CH_3$ | $-CH_3$ |
| VIa-14 | −COOH | H |
| VIa-15 | $-SO_3Na$ | H |
| VIa-16 | $-OCH_3$ | H |

Formula VIb

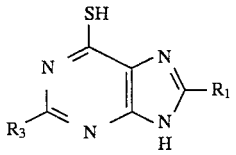

| | $R_1$ | $R_3$ |
|---|---|---|
| VIb-1 | H | H |
| VIb-2 | −OH | H |
| VIb-3 | H | −OH |
| VIb-4 | −OH | −OH |
| VIb-5 | $-CH_3$ | $-CH_3$ |
| VIb-6 | H | −SH |
| VIb-7 | $-NH_2$ | H |
| VIb-8 | H | $-NH_2$ |
| VIb-9 | $-CH_3$ | −OH |
| VIb-10 | $-CH_3$ | $-NH_2$ |
| VIb-11 | −SH | −OH |
| VIb-12 | $-NH_2$ | −SH |

Formula VIc

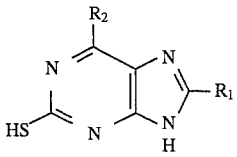

| | $R_2$ | $R_1$ |
|---|---|---|
| VIc-1 | H | H |
| VIc-2 | −OH | H |
| VIc-3 | H | −OH |
| VIc-4 | −OH | $-CH_3$ |
| VIc-5 | $-CH_3$ | −OH |
| VIc-6 | OH | −OH |
| VIc-7 | $-NH_2$ | H |
| VIc-8 | H | $-NH_2$ |
| VIc-9 | −COOH | H |
| VIc-10 | $-OCH_3$ | H |

Formula VII

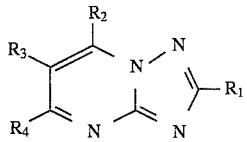

| | $R_1$ | $R_2$ | $R_3$ | $R_4$ |
|---|---|---|---|---|
| VII-1 | −SH | H | H | H |
| VII-2 | −SH | OH | H | H |
| VII-3 | −SH | H | −OH | H |
| VII-4 | −SH | $-CH_3$ | −OH | H |
| VII-5 | −SH | $-NH_2$ | H | H |
| VII-6 | −SH | H | H | $-NH_2$ |
| VII-7 | −SH | H | $-CH_3$ | $-CH_3$ |
| VII-8 | −SH | H | H | −SH |
| VII-9 | −SH | −OH | H | −SH |
| VII-10 | −SH | H | H | −COOH |
| VII-11 | H | −SH | H | H |
| VII-12 | −SH | −SH | H | H |
| VII-13 | H | −SH | −OH | H |
| VII-14 | H | −SH | $-NH_2$ | H |
| VII-15 | H | −SH | −OH | $-CH_3$ |
| VII-16 | H | −SH | $-NH_2$ | $-C_2H_5$ |
| VII-17 | H | −SH | H | $-CH_3$ |
| VII-18 | H | −SH | H | −OH |
| VII-19 | H | −SH | H | −COOH |
| VII-20 | H | −SH | H | $-SO_3H$ |
| VII-21 | H | H | −SH | H |
| VII-22 | −OH | H | −SH | H |
| VII-23 | −OH | $-CH_3$ | −SH | H |
| VII-24 | $-NH_2$ | H | −SH | H |
| VII-25 | −SH | H | −SH | H |
| VII-26 | H | H | H | −SH |
| VII-27 | H | −OH | H | −SH |
| VII-28 | −OH | H | H | −SH |
| VII-29 | $-NH_2$ | H | H | −SH |
| VII-30 | H | $-NH_2$ | H | −SH |
| VII-31 | H | $-NH_2$ | $-CH_3$ | −SH |
| VII-32 | −SH | H | H | −SH |
| VII-33 | −SH | $-CH_3$ | H | −SH |
| VII-34 | H | $-OCH_3$ | H | −SH |
| VII-35 | −SH | −SH | H | −SH |
| VII-36 | H | $-CH_3$ | $-CH_3$ | −SH |

Formula VIII

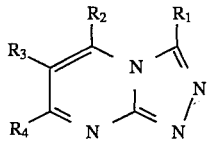

| | $R_1$ | $R_2$ | $R_3$ | $R_4$ |
|---|---|---|---|---|
| VIII-1 | H | H | $-NH_2$ | $-SH$ |
| VIII-2 | H | $-CH_3$ | $-NH_2$ | $-SH$ |
| VIII-3 | H | H | $-SH$ | $-SH$ |
| VIII-4 | $-OH$ | H | $-SH$ | $-SH$ |
| VIII-5 | H | H | $-COOH$ | $-SH$ |
| VIII-6 | H | H | H | $-SH$ |
| VIII-7 | $-OH$ | H | H | $-SH$ |
| VIII-8 | H | $-OH$ | H | $-SH$ |
| VIII-9 | $-CH_3$ | $-OH$ | H | $-SH$ |
| VIII-10 | $-NH_2$ | H | H | $-SH$ |
| VIII-11 | $-OH$ | H | $-SH$ | H |
| VIII-12 | $-NH_2$ | H | $-SH$ | H |
| VIII-13 | $-OH$ | $-CH_3$ | $-SH$ | H |
| VIII-14 | $-NH_2$ | $-C_2H_5$ | $-SH$ | H |
| VIII-15 | H | $-CH_3$ | $-SH$ | H |
| VIII-16 | H | $-OH$ | $-SH$ | H |
| VIII-17 | H | H | $-SH$ | H |
| VIII-18 | $-OH$ | H | $-SH$ | $-CH_3$ |
| VIII-19 | $-OH$ | $-CH_3$ | $-SH$ | H |
| VIII-20 | $-NH_2$ | H | $-SH$ | H |
| VIII-21 | $-SH$ | H | $-SH$ | H |
| VIII-22 | H | $-SH$ | H | $-OH$ |
| VIII-23 | H | $-SH$ | $-OH$ | $-NH_2$ |
| VIII-24 | H | $-SH$ | $-NH_2$ | H |
| VIII-25 | H | $-SH$ | $-COOH$ | H |
| VIII-26 | H | $-SH$ | H | H |
| VIII-27 | $-OCH_3$ | $-SH$ | H | H |
| VIII-28 | H | $-SH$ | H | $-SO_3H$ |
| VIII-29 | $-SH$ | H | H | H |
| VIII-30 | $-SH$ | $-OH$ | H | H |
| VIII-31 | $-SH$ | H | H | $-NH_2$ |
| VIII-32 | $-SH$ | $-CH_3$ | H | H |

Among the compounds represented by Formulas I through VIII, the compounds represented by Formulas I through VI are each preferable to have such an advantage that a developer stain can hardly be produced; that the compound is not much adsorbed on an already processed light-sensitive material, so that the compound can hardly be brought out of a liquid and, therefore, the in-liquid concentration of the compound can readily be maintained; and that the maximum density (Dmax) of an image obtained by developing it cannot much be lowered. The compounds represented by Formula VI are more preferably and the compounds represented by Formula VIc are most preferable.

The compound of the invention is used in an amount within the range of, preferably, $10^{-5}$ to $10^{-1}$ mols per liter of a developing solution and, particularly, $10^{-4}$ to $10^{-2}$ mols per liter.

The compounds of the invention are well-known in the art and readily available on the market.

A tetrazolium compound represented by the following Formula [T] or a hydrazine derivative represented by the following Formula H-a or H-b may preferably be contained in a black and white silver halide light-sensitive material to be processed by the developer of the invention.

Formula [T]

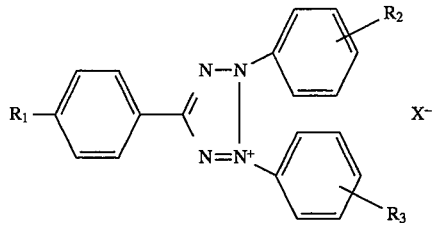

wherein $R_1$, $R_2$ and $R_3$ represent each a hydrogen atom or a substituent; and $X^-$ represents an anion.

Now, the tetrazolium compounds each represented by the above-given Formula IT], which are applicable to the invention will be detailed. In Formula [T], the preferable substituents represented by $R_1$ though $R_3$ include, for example, an alkyl group such as a methyl group, an ethyl group, a cyclopropyl group, a propyl group, an isopropyl group, a cyclobutyl group, a butyl group, an isobutyl group, a pentyl group, and a cyclohexyl group, an amino group, an acylamino group such as an acetylamino group, a hydroxyl group, an alkoxy group such as a methoxy group, an ethoxy group, a propoxy group, a butoxy group and a pentoxy group, an acyloxy group such as an acetyloxy group, a halogen atom such as a fluorine atom, a chlorine atom and a bromine atom, a carbamoyl group, an acylthio group such as an acetylthio group, an alkoxycarbonyl group such as an ethoxycarbonyl group, a carboxyl group, an acyl group such as an acetyl group, a cyano group, a nitro group, a mercapto group, a sulfoxy group, and an aminosulfoxy group.

Such an anion as represented by $X^-$ include, for example, a halogen ion such as chloride ion, bromide ion and iodide ion; an inorganic acid radical such as those of nitric acid, sulfuric acid and perchloric acid; an organic acid radical such as those of sulfonic acid and carboxylic acid; and an anionic type surfactant including, concretely, a lower alkyl benzene sulfonic acid anion such as p-toluene sulfonic acid anion, a higher alkyl benzene sulfonic acid anion such as p-dodecyl benzene sulfonic acid anion, a higher alkyl sulfate anion such as lauryl sulfate anion, a boric acid type anion such as tetraphenyl boron, a dialkyl sulfosuccinate anion such as di-2-ethylhexyl sulfosuccinate anion, a polyether alcohol sulfate anion such as cetyl polyethenoxy sulfate anion, a higher aliphatic anion such as stearic acid anion, and those having an acid radical attached to a polymer such as polyacrylic acid anion.

The typical examples of the compounds represented by Formula IT], which are applicable to the invention, will now be given below.

| Compound No. | $R_1$ | $R_2$ | $R_3$ | $X^-$ |
|---|---|---|---|---|
| T-1 | H | H | H | $Cl^-$ |
| T-2 | H | p-$CH_3$ | p-$CH_3$ | $Cl^-$ |
| T-3 | H | m-$CH_3$ | m-$CH_3$ | $Cl^-$ |
| T-4 | H | o-$CH_3$ | o-$CH_3$ | $Cl^-$ |

-continued

| Compound No. | $R_1$ | $R_2$ | $R_3$ | $X^-$ |
|---|---|---|---|---|
| T-5 | p-$CH_3$ | p-$CH_3$ | p-$CH_3$ | $Cl^-$ |
| T-6 | H | p-$OCH_3$ | p-$OCH_3$ | $Cl^-$ |
| T-7 | H | m-$OCH_3$ | m-$OCH_3$ | $Cl^-$ |
| T-8 | H | o-$OCH_3$ | o-$OCH_3$ | $Cl^-$ |
| T-9 | p-$OCH_3$ | p-$OCH_3$ | p-$OCH_3$ | $Cl^-$ |
| T-10 | H | p-$C_2H_5$ | p-$C_2H_5$ | $Cl^-$ |
| T-11 | H | m-$C_2H_5$ | m-$C_2H_5$ | $Cl^-$ |
| T-12 | H | p-$C_3H_7$ | p-$C_3H_7$ | $Cl^-$ |
| T-13 | H | p-$OC_2H_5$ | p-$OC_2H_5$ | $Cl^-$ |
| T-14 | H | p-$OCH_3$ | p-$OCH_3$ | $Cl^-$ |
| T-15 | H | p-$OCH_3$ | p-$OC_2H_5$ | $Cl^-$ |
| T-16 | H | p-$OC_5H_{11}$ | p-$OCH_3$ | $Cl^-$ |
| T-17 | H | p-$OC_8H_{17}$-n | p-$OC_8H_{17}$-n | $Cl^-$ |
| T-18 | H | p-$C_{12}H_{25}$-n | p-$C_{12}H_{25}$-n | $Cl^-$ |
| T-19 | H | p-$N(CH_3)_2$ | p-$N(CH_3)_2$ | $Cl^-$ |
| T-20 | H | p-$NH_2$ | p-$NH_2$ | $Cl^-$ |
| T-21 | H | p-OH | p-OH | $Cl^-$ |
| T-22 | H | m-OH | m-OH | $Cl^-$ |
| T-23 | H | p-Cl | p-Cl | $Cl^-$ |
| T-24 | H | m-Cl | m-Cl | $Cl^-$ |
| T-25 | p-CN | p-$CH_3$ | p-$CH_3$ | $Cl^-$ |
| T-26 | p-SH | p-$OCH_3$ | p-$OCH_3$ | $Cl^-$ |
| T-27 | H | p-$OCH_3$ | p-$OCH_3$ | 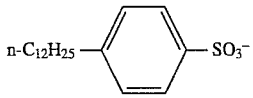 |

The tetrazolium compounds applicable to the invention can readily be synthesized with reference to Chemical Review, Vol. 55, pp. 335–483, for example.

The tetrazolium compounds represented by Formula [T] applicable to the invention are each used in an amount within the range of not less than about 1 mg to about 10 g per mol of the silver contained in a silver halide photographic light-sensitive material and, preferably about 10 mg to about 2 g.

The tetrazolium compounds represented by Formula [T] may be used independently or in combination in an appropriate proportion.

The hydrazine derivatives to be contained in a light-sensitive material preferably applicable to the invention include, for example, those represented by the following Formula H-a or H-b.

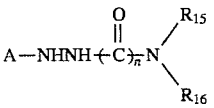

Formula H-a

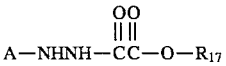

Formula H-b wherein A represents an aryl group or a heterocyclic group containing at least one sulfur atom or an oxygen atom; n is an integer of 1 or 2, provided that, when n is 1, $R_{15}$ and $R_{16}$ represent each a hydrogen atom, an alkyl group, an alkenyl group, an alkinyl group, an aryl group, a heterocyclic group, a hydroxy group, an alkoxy group, an alkenyloxy group, an alkinyloxy group, an aryloxy group or a heterocyclic-oxy group and that $R_{15}$ and $R_{16}$ may also form a ring, together with the nitrogen atom, and provided that, when n is 2, $R_{15}$ and $R_{16}$ represent each a hydrogen atom, an alkyl group, an alkenyl group, an alkinyl group, an aryl group, a saturated or unsaturated heterocyclic group, a hydroxy group, an alkoxy group, an alkenyloxy group, an alkinyloxy group, an aryloxy group or a heterocyclic-oxy group, however, when n is 2, at least one of $R_{15}$ and $R_{16}$ represents an alkenyl group, an alkinyl group, a saturated heterocyclic group, a hydroxy group, an alkoxy group, an alkenyloxy group, an alkinyloxy group, aryloxy group or a heterocyclic-oxy group; and $R_{17}$ represents an alkinyl group or a saturated heterocyclic group.

The compounds represented by Formula H-a or H-b include the compounds in which at least either one of H of —NHNH— is substituted.

For further particulars, A represents an aryl group such as a phenyl group and a naphthyl group, or a heterocyclic group containing at least either one of a sulfur atom and an oxygen atom such as thiophene, furan, benzothiophene and pyrane.

$R_{15}$ and $R_{16}$ represent each a hydrogen atom, an alkyl group such as a methyl group, an ethyl group, a methoxyethyl group, a cyanoethyl group, a hydroxyethyl group, a benzyl group and a trifluoroethyl group, an alkenyl group such as an allyl group, a butenyl group, a pentenyl group and a pentadienyl group, an alkinyl group such as a propargyl group, a butynyl group and a pentynyl group, an aryl group such as a phenyl group, a naphthyl group, a cyanophenyl group and a methoxyphenyl group, a heterocyclic group such as an unsaturated heterocyclic group, e.g., a pyridine group, a thiophene group and furan group, and a saturated heterocyclic group, e.g., a tetrahydrofuran group and a sulfolane group, a hydroxy group, an alkoxy group such as a methoxy group, an ethoxy group, a benzyloxy group and a cyanomethoxy group, an alkenyloxy group such as an allyloxy group and a butenyloxy group, an alkinyloxy group such as a propargyloxy group and a butynyloxy group, an aryloxy group such as a phenoxy group and a naphthyl group, or a heterocyctic-oxy group such as a pyridyloxy group and a pyrimidinyloxy group, provided that, when n is 1, $R_{15}$ and $R_{16}$ may also form a ring such as those of piperidine, piperazine or morpholine together with the nitrogen atom.

In the above, however, when n is 2, at least either one of $R_{15}$ and $R_{16}$ represents an alkenyl group, an alkinyl group, a saturated heterocyclic group, a hydroxy group, an alkoxy group, an alkenyloxy group, an alkinyloxy group, an aryloxy group or a heterocyclic-oxy group.

The typical examples of the alkinyl groups and saturated heterocyclic groups each represented by $R_{17}$ include those given above.

A variety of substituents can be introduced into an aryl group represented by A or a heterocyclic group represented by A that has at least one of sulfur atom or oxygen atom. The substituents which can be introduced thereinto include, for example, a halogen atom, an alkyl group, an aryl group, an alkoxy group, an aryloxy group, an acyloxy group, an alkylthio group, an arylthio group, a sulfonyl group, an alkoxycarbonyl group, an aryloxycarbonyl group, a carbamoyl group, a sulfamoyl group, an acyl group, an amino group, an alkylamino group, an arylamino group, an acylamino group, a sulfonamido group, an arylaminothiocarbonylamino group, a hydroxy group, a carboxy group, a sulfo group, a nitro group, and a cyano group. Among them, a sulfonamido group is preferably used.

In each of the formulas, A is preferable to contain at least one of an antidiffusion group or a silver halide adsorption accelerating group. The antidiffusion groups include, preferably, a ballast group commonly used in an immobile photographic additives such as a coupler. Such a ballast group as mentioned above is a group having not less than 8 carbon atoms that is relatively inert to photographic characteristics. They may be selected out from the group consisting of an alkyl group, an alkoxy group, a phenyl group, an alkylphenyl group, a phenoxy group, and an alkylphenoxy group.

The above-mentioned silver halide adsorption accelerating groups include, for example, the groups given in U.S. Pat. No. 4,385,108, such as a thiourea group, a thiourethane group, a heterocyclic thioamido group, a mercaptoheterocyclic group and a triazole group.

In Formulas H-a and H-b, Hs of —NHNH—, that is a hydrogen atom of hydrazine, may be substituted by a substituent including, for example, a sulfonyl group such as a methanesulfonyl group and a toluenesulfonyl group, an acyl group such as an acetyl group, a trifluoroacetyl group and an ethoxycarbonyl group, and an oxalyl group such as an ethoxalyl group and a pyruvoyl group. The compounds represented by Formulas H-a and H-b include also those given above.

The compounds preferably used in a light-sensitive material to be processed by the developer of the invention are those represented by Formula H-a wherein n is 2 and those represented by Formula H-b.

In the compounds represented by Formula H-a wherein n is 2, it is more preferable to use the compounds wherein $R_{15}$ and $R_{16}$ represent each a hydrogen atom, an alkyl group, an alkenyl group, an alkinyl group, an aryl group, a saturated or unsaturated heterocyclic group, a hydroxy group or an alkoxy group, and wherein at least either one of $R_{15}$ and $R_{16}$ represents an alkenyl group, an alkinyl group, a saturated heterocyclic group, a hydroxy group or an alkoxy group.

The typical compounds represented by Formulas H-a and H-b include those given below.

Typical examples of the compounds

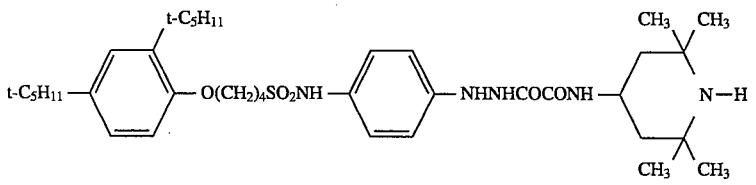

a-1

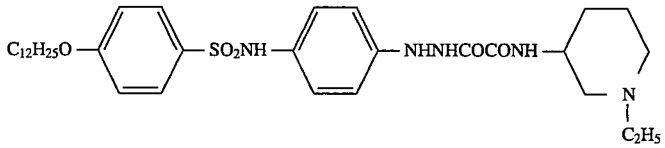

a-2

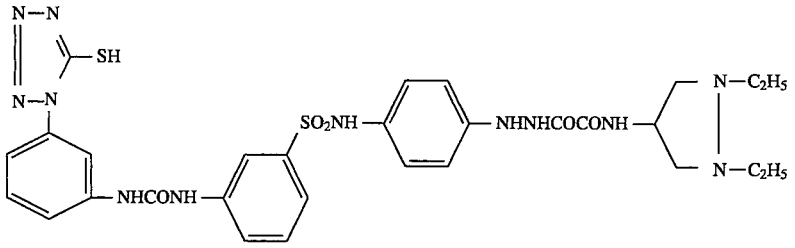

a-3

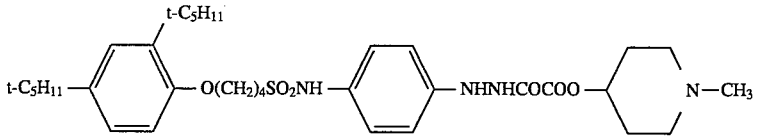

b-1

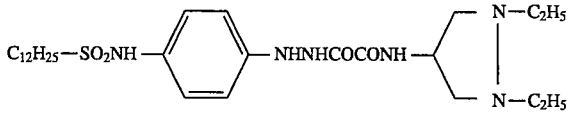

a-4

-continued a-5

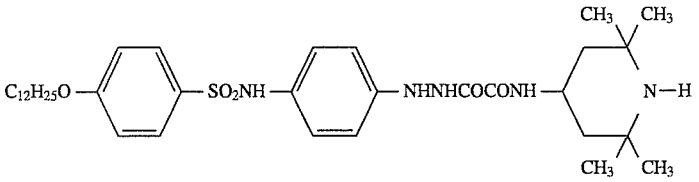

b-2

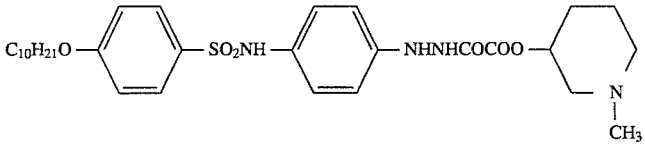

a-6

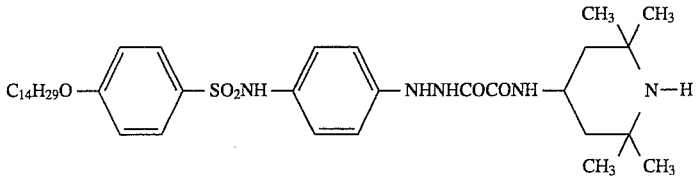

b-3

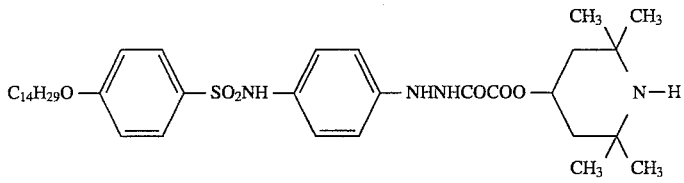

a-7

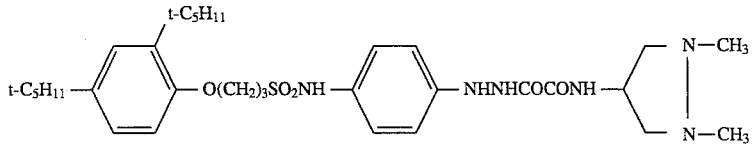

b-4

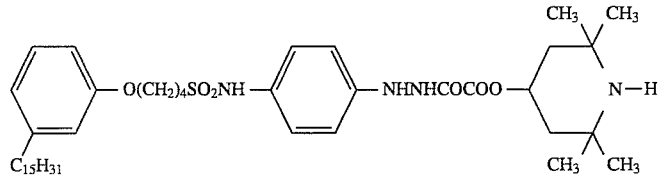

a-8

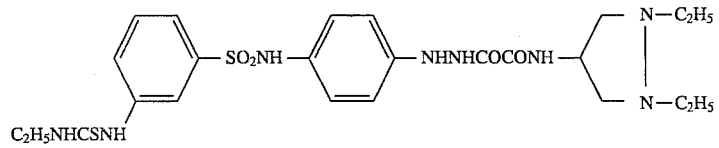

b-5

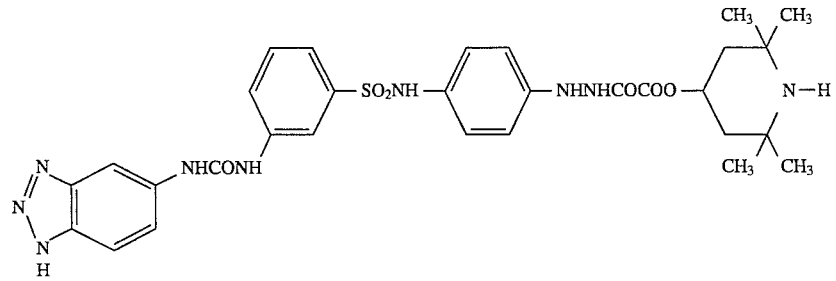

Besides the above examples, the other concrete examples of the compounds include further the exemplified compounds (1) through (61) and (65) through (75) each given in JP OPI Publication No. 2-841/1990, pp. 542(4)–546 (8) .

The hydrazine derivatives can be synthesized in the process detailed in, for example, JP OPI Publication No. 2-1990, pp. 546(8)–550 (12).

The hydrazine derivatives may be added to a silver halide emulsion layer and/or a layer adjacent thereto. The derivatives may be added in an amount within the range of, preferably, $1\times10^{-6}$ to $1\times10^{-1}$ mols per mol of a silver content and, more preferably, $1\times10^{-5}$ mols to $1\times10^{-2}$ mols.

When the above-mentioned hydrazine derivative contains a compound represented by Formula H-a or H-b and for further enhancing the contrast hardening effect thereof, it is preferable that a silver halide emulsion layer and/or a non-light sensitive layer arranged to the silver halide emulsion layer side are to contain at least one kind of the nucleation-accelerating compounds given in JP OPI Publication No. 4- 98239/1992, on the 1st line of the lower left column of p. 607 (7) to the 11th line of the lower left column of p. 626(26).

As the nucleation-accelerating compound, an amine compound, a hydrazine compound other than the above-mentioned, a tertiary-onium chloride compound, or a carbinol compound may be used. Among them, an amine compound and a carbinol compound are preferable. It is further preferable that the compounds have each a antiduffusion group or a silver halide absorption accelerating group described in the above. The nucleation-accelerating compound may be added to a silver halide emulsion layer and/or a layer adjacent thereto. The compound may be added in an amount within the range of $1\times10^{-6}$ to $5\times10^{-2}$ mols, preferably $1\times10^{-5}$ to $1\times10^{-2}$ mols, per mol of silver contained in the emulsion layer.

The typical examples of the nucleation-accelerating compounds will now be given below.

N-1

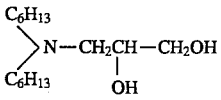

N-2

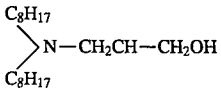

N-3

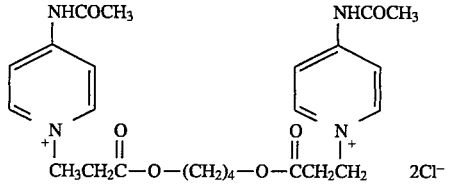

N-4

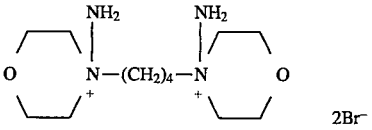

N-5

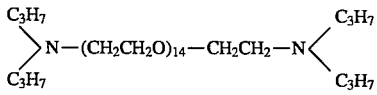

N-6

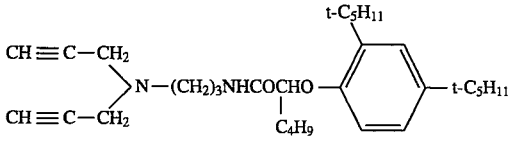

N-7

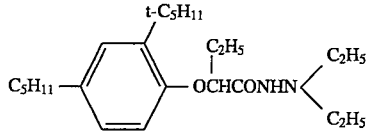

N-8

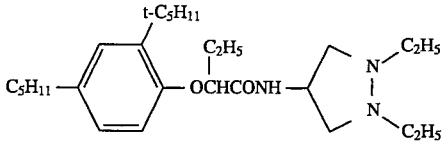

-continued

N-9

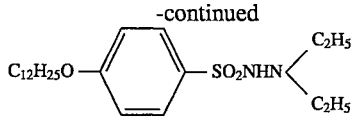

N-10

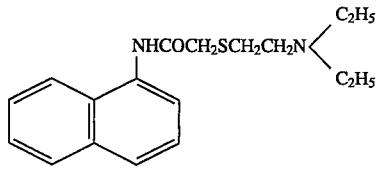

N-11

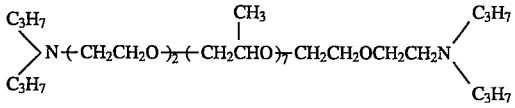

Besides the above-given typical examples, the other examples thereof include, further, Compounds I-1 through I-26 given in JP OPI Publication No. 4-98239/1992, p. 608(8); Compounds II-1 through II-29, ibid., pp. 609(9)–610(10); Compounds III-1 through III-25, ibid., pp. 610(10)–611(11); Compounds IV-1through IV-41, ibid., pp. 611(11)–613(13); Compounds V-I-1 through V-I-27, ibid., pp. 613(13)–614(14); Compounds V-II-1 through V-II-30, ibid., pp. 615(15)–616(16); Compounds V-III-1 through V-III-35, ibid., p. 616(16)-; Compounds VI-I-1 through VI-I-44, ibid., pp. 618(18)–620(20); Compounds VI-II-1 through VI-II-68, ibid., pp. 621(21)–626(24); and Compounds VI-II-1 through VI-III-35, ibid., pp. 624(24)–626(26).

In a light-sensitive material to preferably be processed by the developer of the invention, it is preferable to provide a conductive layer to the support of the light-sensitive material. The typical methods for forming a conductive layer include a method of forming a conductive layer by making use of a water-soluble conductive polymer, a hydrophobic polymer and a hardener, and another method of forming a conductive layer by making use of a metal oxide. As for one of these methods, a method described in JP OPI Publication No. 3- 265842/1991, pp. (5)–(15) may be used.

In a silver halide emulsion layer of the light-sensitive material silver halide grains containing silver chloride in a proportion of not less than 50 mol % are contained.

Silver halide grains such as mentioned above are preferable to be monodisperse type grains having a variation coefficient of not more than 15%. A variation coefficient is to be expressed in the terms of (a standard grain-size deviation)/(an average grain size)×100.

In the silver halide emulsion, a variety of techniques and additives each well-known in the art can be used. For example, a silver halide photographic emulsion and a backing layer each may contain a variety of a chemical sensitizer, a color toner, a surfactant, a thickener, a plasticizer, a lubricant, a development inhibitor, a UV absorbent, anti-irradiation dye, a heavy metal, and a matting agent, in various methods. Further, a silver halide photographic emulsion and a backing layer each may contain a polymer latex.

Further details of these additives are described in, for example, Research Disclosure No. 176, Item/7643, (Dec., 1978) and ibid. , No. 187, Item/8716, (Nov., 1979) .

The supports applicable to the silver halide photographic light-sensitive material include, for example, those made of a polyester such as cellulose acetate, cellulose nitrate and polyethylene terephthalate, a polyolefin such as polyethylene, polystyrene, baryta paper, polyolefin-coated paper, glass plate and metal plate. These supports may be subbing treated, if required.

The developing agents applicable to the developer compositions of the invention include, for example, the following compounds applicable independently or in combination thereof. Namely, a dihydroxy benzene such as hydroquinone, chlorohydroquinone, bromohydroquinone, 2,3-dichlorohydroquinone, methyl hydroquinone, isopropyl hydroquinone and 2,5-dimethyl hydroquinone, a 3-pyrazolidone such as 1-phenyl-3-pyrazolidone, 1-phenyl-4-methyl-3-pyrazolidone, 1-phenyl-4,4-dimethyl-3-pyrazolidone, 1-phenyl- 4-ethyl-3-pyrazolidone and 1-phenyl-5-methyl-3-pyrazolidone, an aminophenol such as o-aminophenol, p-aminophenol, N-methyl-o-aminophenol, N-methyl-p-aminophenol and 2,4-diaminophenol, pyrogallol, ascorbic acid, 1-aryl-3-pyrazoline such as 1-(p-hydroxyphenyl)- 3-aminopyrazoline, 1-(p-methyl aminophenyl)-3-aminopyrazoline, 1-(p-aminophenyl)-3-aminopyrazoline and 1-(p-amino-N-methylphenyl)- 3-aminopyrazoline. Among them, a combination of a 3-pyrazolidone and a dihydroxybenzene, and a combination of an aminophenol and a dihydroxybenzene are preferably used. The above-mentioned developing agent is ordinarily used in an amount within the range of, preferably, 0.01 to 1.4 mols per liter of a developing solution used.

In the composition of the invention, a sulfite and a metabisulfite each serving as a preservative include, for example, sodium sulfite, potassium sulfite, ammonium sulfite and sodium metabisulfite. Such a sulfite as mentioned above are used in an amount of, preferably not less than 0.25 mols per liter and, more preferably not less than 0.4 mols per liter.

Besides the above, if required, the developer composition may be added by the following additives. Namely, an alkalizer such as sodium hydroxide and potassium hydroxide, a pH buffer such as a carbonate, a phosphate, a borate, boric acid, acetic acid, citric acid and alkanol amine, a dissolving aid such as a polyethylene glycol and a ester thereof and alkanol amine, a sensitizer such as a non-ionic surfactant including a polyoxyethylene, and a quaternary ammonium compound, a surfactant, a defoamer, an antifoggant such as a halide including potassium bromide and sodium bromide, nitrobenzindazole, nitrobenzimidazole, benzotriazole, benzothiazole, a tetrazole and a thiazole, a chelating agent such as ethylenediamine tetraacetic acid and an alkali-metal salt thereof, a nitrilotriacetate and a polyphosphate, a development accelerator such as the compounds given in, for example, U.S. Pat. No. 2,304,025 and JP Examined Publication No. 47-45541/1972, a hardener such as glutaraldehyde and a bisulfite adduct thereof and a defoamer. The pH of a developer is required to be lower than 11.5 and, preferably within the range of not lower than 9.5 to lower than 11.5.

As for a peculiar mode of carrying out a development process, a compound of the invention may also be added to an activation-processing solution in which a developing agent is contained in a light-sensitive material including, for example the emulsion layer thereof and the light-sensitive material is so processed in an alkaline solution as to perform a development process. Such a development process as mentioned above is mostly utilized upon combining the development process and a silver salt stabilizing process using a thiocyanate therein, as one of the rapid processes for a light-sensitive material. The compounds of the invention may also applicable to such a processing solution as mentioned above.

A fixing solutions having a commonly applicable composition can be used in the processing including the developing step using a developer of the invention. A fixing solution is an aqueous solution commonly comprising a fixing agent and others, and it has usually a pH within the range of 3.8 to 5.8. The fixing agents applicable thereto comprise not only a thiosulfate such as sodium thiosulfate, potassium thiosulfate and ammonium thiosulfate, and a thiocyanate such as sodium thiocyanate, potassium thiocyanate and ammonium thiocyanate, but also an organic sulfur compound capable of producing a soluble and stable silver complex that is well-known as a fixing agent.

A fixing solution may be added by a water-soluble aluminium salt such as aluminium chloride, aluminium sulfate and potassium alum, which may be able to function as a layer hardener.

If required, a fixing solution may contain a compound serving as a preservative such as a sulfite and a bisulfite, a pH buffer such as acetic acid, a pH controller such as sulfuric acid, and a chelating agent capable of softening hard water.

A developer composition may be any one of a mixture of solid components, an aqueous organic solution containing glycol or amine, and a viscous liquid phase in a kneaded state which is high in viscosity. The developer component may also be diluted before making use of it or may be used as it is.

When carrying out a development process relating to the invention, a development temperature may be set either within the range of 20° to 30° C. as an ordinary temperature, or within the range of 30° to 40° C. for carrying out a high-temperature process.

A black-and-white silver halide photographic light-sensitive material to be developed with the developer of the invention is preferable to be processed through an automatic processor. In this case, the light-sensitive material is processed while supplying a replenisher in a specific amount in proportion to the area of the light-sensitive material. For reducing a waste solution, the developing replenisher is to preferably be supplied in an amount of not more than 250 ml and, particularly, within the range of not less than 75 ml to not more than 200 ml each per $m^2$ of the subject light-sensitive material.

Taking a demand for shortening a developing time in the invention, it is preferable to take the whole dry to dry processing time, within the range of 20 to 60 seconds from the point of time when inserting the leading edge of a subject film into an automatic processor to the point of time when the leading edge comes out of the drying zone of the automatic processor. The term, "the whole processing time", herein includes the whole processing time necessary to process a black-and-white silver halide photographic light-sensitive material. To be more concrete, this term includes the periods of time for carrying out, for example, the steps of developing, fixing, bleaching, washing, stabilizing and drying a light-sensitive material subject to the process, that is, in short, a Dry to Dry time. Therefore, the further preferable whole processing time or Dry to Dry time is within the range of 30 to 60 seconds.

EXAMPLES

Example 1

(Preparation of Silver Halide Photographic Emulsion A)

In a double-jet precipitation process, a silver chlorobromide emulsion (having a silver chloride content of 65 mol % per mol of silver) was prepared. In the course of mixing the materials, $K_2IrCl_6$ and $Na_2RhCl_6$ were added in the amounts of $8\times10^{-7}$ mols and $1\times10^{-7}$ mols each per mol of silver, respectively. The resulting emulsion was proved to be comprised of cubic monodisperse type grains having an average grain size of 0.20 μm and having a variation coefficient of 10%.

The emulsion was washed and desalted in an ordinary method. Thereafter, a mixture of Compounds [A], [B] and [C] was added and a gold sulfur sensitization was applied thereto, so that Emulsion A was obtained.

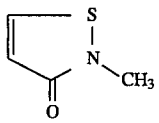

Compound [A]

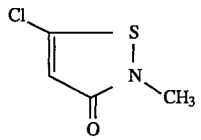

Compound [B]

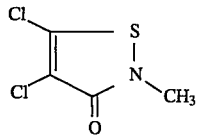

Compound [C]

(Preparation of Silver Halide Photographic Light-Sensitive Material)

A 100 μm-thick polyethylene terephthalate film was coated with a 0.1-thick under-coat layer on each of the both sides thereof, about which, refer to JP OPI Publication No. 59- 19941/1984. On one of the under-coat layers, a silver halide emulsion layer having the following Composition (1) was coated so as to have a gelatin content and a silver content in the proportions of 1.5 g/m² and 3.2 g/m², respectively. Further thereon, an emulsion protective layer having the following Composition (2) was coated so as to have a gelatin content in a proportion of 1.0 g/m². On the opposite side of the undercoat layer, a backing layer having the following Composition (3) was coated so as to have a gelatin content in a proportion of 2.4 g/m². Further thereon, a backing protective layer having the following Composition (4) was coated so as to have a gelatin content in a proportion of 1 g/m². Thereby, a sample was prepared.

Composition (1)
(Composition of the Silver Halide Emulsion Layer)

| | |
|---|---|
| Gelatin (contained in an emulsion layer) | 1.5 g/m² |
| Silver halide emulsion A (in terms of silver content) | 3.2 g/m² |
| Sensitizing dye: SD-1 | 1.0 mg/m² |
| Stabilizer: 4-methyl-6-hydroxy-1,3,3a,7-tetrazaindene | 30 mg/m² |
| Antifoggants: Adenine | 10 mg/m² |
| 5-sodium sulfonate-2-mercaptobenzimidazole | 5 mg/m² |
| Surfactants: Saponin | 0.1 g/m² |
| S-1 | 8.0 mg/m² |
| Hydrazine derivatives: a-1 | 10 mg/m² |
| a-3 | 2 mg/m² |
| Nucleation accelerator: N-11 | 50 mg/m² |
| Polyethylene glycol (having a molecular weight of 4000) | 0.1 g/m² |
| Sensitizing dye: SD-1 | |

-continued

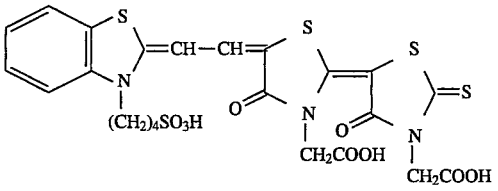

| | |
|---|---|
| Surfactant: S-1 | 8 mg/m² |

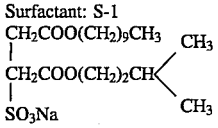

Composition (2) (Composition of Emulsion Protective Layer)

| | |
|---|---|
| Gelatin | 0.9 g/m² |
| Surfactants: S-2 | 10 mg/m² |

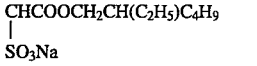

| | |
|---|---|
| Surfactants: S-3 | 5 mg/m² |

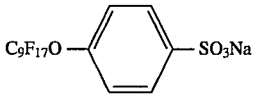

| | |
|---|---|
| Matting agent: Monodisperse silica particles having an average size of 3.5 μm | 10 mg/m² |
| Hardener: 1,3-vinylsulfonyl-2-propanol | 40 mg/m² |

Composition (3) (Composition of Backing Layer)

| | |
|---|---|
| Antihalation dye (a) | 70 mg/m² |

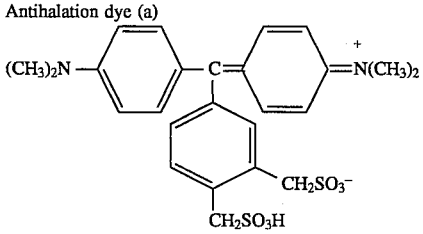

| | |
|---|---|
| Antihalation dye (b) | 50 mg/m² |

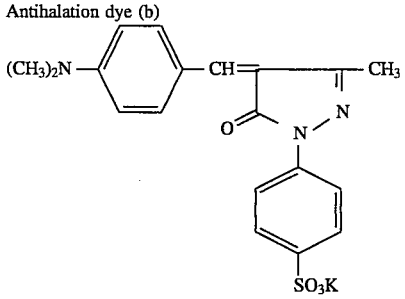

| | |
|---|---|
| Antihalation dye (c) | 20 mg/m² |

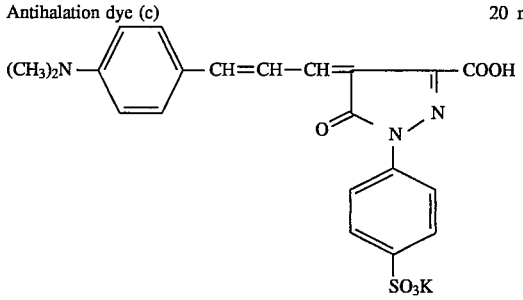

| | |
|---|---|
| Gelatin | 2.4 g/m$^2$ |
| Surfactants: Saponin | 0.1 g/m$^2$ |
| S-1 | 6 mg/m$^2$ |
| Colloidal silica | 100 mg/m$^2$ |
| Composition (4) (Composition of Backing Protective Layer) | |
| Gelatin | 1 g/m$^2$ |
| Matting agent: Monodisperse polymethyl methacrylate particles having an average size of 3.5 μm | 40 mg/m$^2$ |
| Surfactant: S-2 | 10 mg/m$^2$ |
| Hardener: Glyoxal | 35 mg/m$^2$ |

Next, the following developing step was carried out by making use of the following developing solution and fixing solution, through an automatic plate-making processor, Model GQ.26SR (manufactured by Konica Corp.), under the following conditions.

<Processing Conditions>

| | |
|---|---|
| [Composition of Developing Solution] | |
| Disodium ethylenediamine tetraacetate | 2 g |
| Diethylene glycol | 25 g |
| Potassium sulfite (in an aqueous 55% W/V solution) | 114 ml |
| Potassium carbonate | 55 g |
| Hydroquinone | 20 g |
| 5-methylbenzotriazole | 300 mg |
| Compound of the invention having or the comparative compound (See Table 1) | $1.0 \times 10^{-3}$ mols |
| Potassium hydroxide | An amount to make the pH of a developing solution to be 10.5 |
| Potassium bromide | 3.3 g |
| 1-phenyl-3-pyrazolidone | 750 mg |
| Add pure water to make | 1 liter |
| [Composition of Fixing Solution] | |
| (Sub-Composition A) | |
| Ammonium thiosulfate (in an aqueous 72.5% W/V solution) | 230 ml |
| Sodium sulfite | 9.5 g |
| Sodium acetate.trihydrate | 28 g |
| Boric acid | 6.7 g |
| Sodium citrate.dihydrate | 2 g |
| Acetic acid (in an aqueous 90% W/W solution) | An amount to make the pH of the fixing solution to be 4.7 |
| (Sub-Composition B) | |
| Pure water | 17 ml |
| Sulfuric acid (in an aqueous 50% W/W solution) | 2.5 g |
| Aluminium sulfate (in an aqueous solution having a 8.1% content thereof in terms of $Al_2O_3$) | 21 g |
| Before making use of the fixing solution, dissolve Sub-Compositions A and B in this order with 500 ml of water to make | 1 liter |

<Processing Conditions>

[Conditions for Processing Steps]

| Processing step | Temperature | Time |
|---|---|---|
| Developing | 38° C. | 12 sec. |
| Fixing | 35° C. | 10 sec. |
| Washing | At ordinary temp. | 10 sec. |
| Drying | 50° C. | 13 sec. |
| Total: | | 45 sec. |

Each of the processing time include every period of time required to transport a subject light-sensitive material from one step to the following step, that is so-called a cross-over time.

When replenishing the developing solution or fixing solution, the replenishers having the same composition as in the corresponding solution subject to be replenished were replenished while keeping the replenishing rates to be 160 cc/m$^2$ to the developing solution and to be 190 cc/m$^2$ to the fixing solution, so that 30 m$^2$ of a sample was processed.

For checking up a silver stain adhered on the sample after completing a process, an unexposed 3.5×12 cm-sized film piece was processed and the possibly resulting stains produced on the film surface were observed with the eye. The stains produced by the development were visually evaluated by five ranks.

5: No stain was observed

4: Slight stain was observed

3: A little stain was observed

2: Fairly stain was observed

1: Remarkable stain was observed

When a subject film is ranked to be lower than 3, it means that the film cannot practically be used.

Development rate:

A sample was stepwise exposed to He-Ne laser beam for $10^{-6}$ seconds and was then developed under the foregoing conditions. The resulting sensitivity was indicated by a relative value.

Fixing rate:

By making use of the same fixing solution as used in fixing the foregoing film having an area of 30 m$^2$, the time in second required for making a subject light-sensitive material sample become transparent was measured and it was indicated by a relative fixing rate.

Preservability:

A prepared developing solution was filled in a polyethylene-made package and heated at 60° C. for 20 days. After heating it, a silver stain test was tried and evaluated by 5 ranks in the above-mentioned manner. It means that the more a rank is closer to rank 5, the less a silver stain prevention effect is deteriorated even when a developing solution is heated. When a rank is lower than 3, the subject film cannot practically be used.

The results of the evaluation will be shown in Table 1 below.

TABLE 1

| Test | Compound contained in developer | Development stain | Developing rate | Fixing rate | Preserv-ability | Remarks |
|---|---|---|---|---|---|---|
| 1 | — | 1 | 100 | 100 | 1 | Comparison |
| 2 | Comparative compound A | 3 | 59 | 45 | 2 | Comparison |
| 3 | Comparative compound B | 4 | 66 | 100 | 2 | Comparison |
| 4 | Comparative compound C | 4 | 70 | 90 | 2 | Comparison |
| 5 | Exemplified compound I-1 | 4 | 96 | 98 | 5 | Invention |
| 6 | Exemplified compound I-4 | 5 | 100 | 100 | 4 | Invention |
| 7 | Exemplified compound I-5 | 5 | 100 | 100 | 4 | Invention |
| 8 | Exemplified compound I-6 | 5 | 95 | 97 | 4 | Invention |
| 9 | Exemplified compound II-1 | 4 | 98 | 100 | 5 | Invention |
| 10 | Exemplified compound II-6 | 5 | 100 | 100 | 5 | Invention |
| 11 | Exemplified compound II-7 | 5 | 100 | 100 | 5 | Invention |
| 12 | Exemplified compound III-5 | 5 | 100 | 100 | 5 | Invention |
| 13 | Exemplified compound IV-1 | 5 | 100 | 100 | 5 | Invention |
| 14 | Exemplified compound V-4 | 5 | 100 | 100 | 4 | Invention |

Comparative compound A: 1-phenyl-5-mercaptotetrazole,
Comparative compound B: 2-mercaptobenzimidazole, and
Comparative compound C: Bisphenyl acetic acid-2-disulfide As is apparent from Table 1, Test Nos. 5 through 14 in which a developing solution prepared by adding a compound of the invention was proved that almost no development stain was produced, that both of the developing rate and fixing rate were not lowered, and that the preservability of the developing solution was excellent.

Example 2

In the presence of water-soluble iridium in an amount of $2\times10^{-6}$ mols per mol of silver and water-soluble rhodium in an amount of $4\times10^{-7}$ mols per mol of silver and while controlling EAg and VpH to be kept at 120 m and 3.0, respectively, silver chlorobromide grains containing silver chloride of 70 mol % was prepared. These grains were proved to be cubic grains having an average grain size of 0.24 μm and a grain size distribution range of 11%. After the resulting grains were gold and sulfur sensitized, an orthochromatic sensitizing dye was added thereto, then, 4-hydroxy-6-methyl-1,3,3a, 7-tetrazaindene, as a stabilizer, in an amount of 1 g per mol of silver and a tetrazolium compound, T-14, in an amount of 200 mg per mol of silver were each added thereto, further, sodium n-dodecylbenzene sulfonate in an amount of 600 mg per mol of silver and a styrene-maleic acid copolymer in an amount of 2 g per mol of silver were each added. After the pH of the mixture thereof was controlled to be 5.8 by making use of citric acid, the resulting mixture was coated on a polyethylene terephthalate film. At that time, a hardening protective layer containing sodium 1-decyl-2-(3-isopentyl) succinate-2-sulfonate, as a spreading agent, in an amount of 30 mg/m$^2$ and formalin, as a hardener, in an amount of 25 mg/m$^2$ was multilayered so that the gelatin content could be in an amount of 1.0 g/m$^2$.

Next, to the side of a support opposite to an emulsion layer, a backing layer having the following composition was arranged in quite the same manner as in Example 2 given in JP OPI Publication No. 2-226143/1990.

| | |
|---|---|
| Propyl gallate | 300 mg/m$^2$ |
| A styrene-maleic acid copolymer | 100 mg/m$^2$ |
| Alkali-processed gelatin (having an isoelectric point of 4.9) | 1.0 g/m$^2$ |
| Formalin | 10 mg/m$^2$ |

After controlling the pH with citric acid to be 5.4, the backing layer was coated and dried up.

Then, a developing process was carried out by making use of the following developing solution and fixing solution through an automatic processor, Model GQ.26SR (manufactured by Konica Corp.), under the following conditions.

The subject film was processed without exposing it to light.

| <Processing conditions> | |
|---|---|
| Composition of Developing Solution | 150 ml |
| (Sub-Composition A) | |
| Pure water (ion-exchanged water) | 150 ml |
| Disodium ethylenediamine tetraacetate | 2 g |
| Diethylene glycol | 50 g |
| Potassium sulfite (in an aqueous 55% w/v solution) | 100 ml |
| Potassium carbonate | 50 g |
| Hydroquinone | 15 g |
| Compound of the invention having Formula [1] used in Example 1 or | $1.0\times10^{-3}$ mols |

-continued

<Processing conditions>

| | |
|---|---|
| a comparative compound used therein | |
| Potassium hydroxide | An amount to make the pH of the solution used to be 10.4 |
| Potassium bromide | 4.5 g |
| (Sub-Composition B) | |
| Pure water (ion-exchanged water) | 3 ml |
| Diethylene glycol | 50 g |
| Disodium ethylenediamine tetraacetate | 25 mg |
| Acetic acid (in an aqueous 90% solution) | 0.3 ml |
| 1-phenyl-3-pyrazolidone | 700 mg |
| 5-nitroindazole | 110 mg |
| Before using the developing solution, dissolve Sub-Compositions A and B in this order in 500 ml of water so as to make | 1 liter |
| Composition of Fixing Solution | |
| (Sub-Composition A) | |
| Ammonium thiosulfate (in an aqueous 72.5% w/v solution) | 240 ml |
| Sodium sulfite | 17 g |
| Sodium acetate.trihydrate | 6.5 g |
| Boric acid | 6 g |
| Sodium citrate.dehydrate | 2 g |
| Acetic acid (in an aqueous 90% W/W solution) | 13.6 ml |
| (Sub-Composition B) | |
| Pure water (ion-exchange water) | 17 ml |
| Sulfuric acid (in an aqueous 50% W/W solution) | 4.7 g |
| Aluminium sulfate (in an aqueous solution having a 8.1% content thereof in terms of $Al_2O_2$) | 26.5 g |
| Before making use of the fixing solution, dissolve Sub-Compositions A and B in this order with 500 ml of water to make | 1 liter |
| The pH of the resulting fixing solution was about | 4.3. |

-continued

<Processing conditions>

Conditions for Processing Steps

| Processing step | Temperature | Time |
|---|---|---|
| Developing | 38° C. | 12 sec. |
| Fixing | 35° C. | 10 sec. |
| Washing | at ordinary temp. | 10 sec. |
| Drying | 50° C. | 13 sec. |
| Total: | | 45 sec. |

Each of the processing time include every period of time required to transport a subject light-sensitive material from one step to the following step, that is so-called a cross-over time.

When replenishing the developing solution or fixing solution, the replenishers having the same composition as in the corresponding solution subject to be replenished were replenished while keeping the replenishing rates to be 160 cc/m$^2$ to the developing solution and to be 190 cc/m$^2$ to the fixing solution, so that 30 m$^2$ of a sample was processed.

Each of the evaluation was tried in the following manners.

Except the evaluation of the developing rate, the silver stain, fixing rate and preservability were evaluated in the same manners as in Example 1.

Developing rate:

Through an ordinary type Gray-negative 150L contact screen available on the market, a sample was exposed 3-stepwise to tungsten light and was then processed under the foregoing conditions. The resulting sensitivity thereof is indicated by a relative sensitivity.

The results of the evaluation will be given in Table 2.

TABLE 2

| Test | Compound contained in developer | Development stain | Developing rate | Fixing rate | Preservability | Remarks |
|---|---|---|---|---|---|---|
| 1 | — | 1 | 100 | 100 | 1 | Comparison |
| 2 | Comparative compound A | 3 | 55 | 41 | 2 | Comparison |
| 3 | Comparative compound B | 4 | 60 | 98 | 2 | Comparison |
| 4 | Comparative compound C | 4 | 71 | 87 | 2 | Comparison |
| 5 | Exemplified compound I-1 | 4 | 96 | 98 | 5 | Invention |
| 6 | Exemplified compound I-4 | 5 | 100 | 100 | 4 | Invention |
| 7 | Exemplified compound I-5 | 5 | 100 | 100 | 4 | Invention |
| 8 | Exemplified compound I-6 | 5 | 95 | 97 | 4 | Invention |
| 9 | Exemplified compound II-1 | 4 | 98 | 98 | 5 | Invention |
| 10 | Exemplified compound II-6 | 5 | 99 | 100 | 5 | Invention |
| 11 | Exemplified compound II-7 | 5 | 100 | 100 | 5 | Invention |
| 12 | Exemplified compound III-5 | 5 | 100 | 100 | 5 | Invention |

TABLE 2-continued

| Test | Compound contained in developer | Development stain | Developing rate | Fixing rate | Preserv-ability | Remarks |
|---|---|---|---|---|---|---|
| 13 | Exemplified compound IV-1 | 5 | 98 | 99 | 5 | Invention |
| 14 | Exemplified compound V-4 | 5 | 100 | 100 | 4 | Invention |

Comparative compounds A, B and C: The same as given in Table 1

As is apparent from Table 2, Test Nos. 5 through 14 in which a developing solution prepared by adding a compound of the invention was proved that almost no development stain was produced, that both of the developing rate and fixing rate were not lowered, and that the preservability of the developing solution was excellent.

Example 3

A subbed polyethylene terephthalate support was corona-discharged by an energy of 8 W/($m^2$.min) and, thereon, an antistatic solution having the following composition was coated by making use of a roll-fit coating pan and an air-knife at a speed of 30 m/min. so as to be the following amount coated.

(Preparation of Support having a Conductive Layer)

A subbed 100 μm-thick polyethylene terephthalate support was corona-discharged and was then coated with an antistatic solution having the following composition at a coating speed of 70 m/min. by making use of a roll-fit coating pan and an air-knife.

| | |
|---|---|
| Water-soluble conductive polymer, P-6 | 0.6 g/$m^2$ |
| Hydrophobic polymer particle, L-1 | 0.4 g/$m^2$ |
| Polyethylene oxide compound, Ao-1 | 0.06 g/$m^2$ |

-continued

| | |
|---|---|
| Layer hardener, E-8 | 0.2 g/$m^2$ |

The antistatic solution having the above-given composition was dried for 2 minutes and then heated at 140° C. for 90 seconds. The resulting conductive layer was coated on one side of a support so as to be completed.

P-6

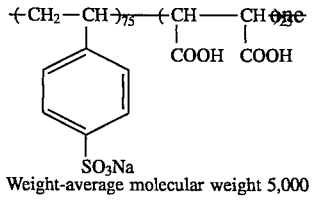

Weight-average molecular weight 5,000

L-1

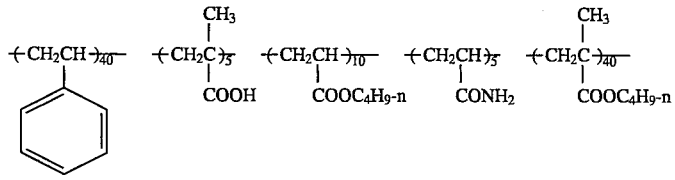

$HO(CH_2CH_2O)_nH$ [n = 15] [Ao-1]

E-8

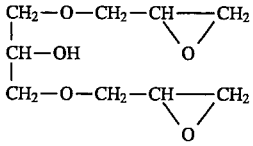

(Preparation of Silver Halide Emulsion)

In a double-jet precipitation process, a silver chloroiodobromide emulsion having a silver chloride content of mol % and a silver iodide content of 0.5 mol % and the rest was silver bromide was prepared.

In the course of carrying out a mixing step from the point of time when 5% of the grains have the finalized average grain size to the point of time when the whole grain have the finalized average grain size, potassium hexabromorhodium salt and potassium hexachloroiridium salt were added in the amounts of $8\times10^{-8}$ mols and $8\times10^{-7}$ mols each per mol of silver, respectively.

The resulting emulsion was desalted in an ordinary flocculation process by making use of a modified gelatin processed with phenyl isocyanate and was then dispersed in gelatin. Thereafter, Compounds [A], [B] and [C] each used in Example 1 were added as the antimolds, so that an emulsion comprising cubic monodisperse type grains having an average grain size of 0.30 μm, also having a variation coefficient of 10% could be prepared.

After adding citric acid, sodium chloride and 1-phenyl-5-mercaptotetrazole to the resulting emulsion, chloroauric acid and sodium thiosulfate were added thereto and the mixture thereof was chemically ripened at 60° C. After reaching the maximum sensitivity, 4-hydroxy-6-methyl-1,3,3a, 7-tetrazaindene was added in an amount of 1 g per mol of silver so as to stop the ripening treatment. Thereafter, potassium bromide and sensitizing dye SD-1 were added in the amounts of 600 mg and 150 mg per mol of silver halide, respectively.

(Preparation of Emulsion Coating Solution)

The resulting emulsion was added by the following material each per mol of silver halide; namely, hydroquinone in an amount of 4 g, polymer latex P-1 having the following composition in an amount of 15 g, inhibitor ST-1 in an amount of 150 mg, a styrene-maleic acid polymer in an amount of 2 g, a 1N sodium hydroxide solution, S-2 having the following composition in an amount of 1.5 g, saponin as a coating aid and a sodium salt of 2,4-dichloro-6-hydroxy-1,3,5-triazine as a layer hardener.

(Preparation of Emulsion Protective Layer Coating Solution)

To an aqueous solution containing gelatin in an amount of 1.1 g per $m^2$, the following materials were added; namely, the formalin adduct of sodium bisulfite in an amount of 1 mg, 1-phenyl- 4-hydroxymethyl-3-pyrazolidone in an amount of 5.5 mg, monodisperse type silica having the average particle sizes of 3 μm and 8 μm each in an amount of 15 mg, S-4 having the following composition as a coating aid, and citric acid and, also, formalin as a layer hardener. Further, a fluorine type surfactant S-3 was added in such an amount that the amount coated could be $3\times10^{-6}$ mols.

(Preparation of Backing Layer Coating Solution)

To an aqueous solution containing gelatin in an amount of 2.3 g per $m^2$, the following materials were added and the stirred; namely, the foregoing water-soluble antihalation dyes (b), (c) and (a) in the amounts of 100 mg, 25 mg and 100 mg, respectively, polymer latex P-1 in an amount 350 mg, a styrene-maleic acid polymer in an amount of 60 mg, colloidal silica in an amount of 150 mg, a mixture of compounds [A], [B] and [C], sodium dodecylbenzenesulfonate as a coating aid, glyoxal as a layer hardener and E-2 in an amount of 55 mg.

P-1

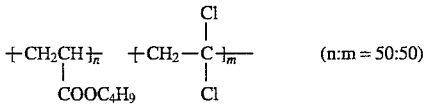

E-2

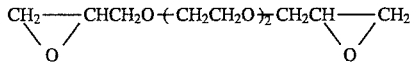

ST-1

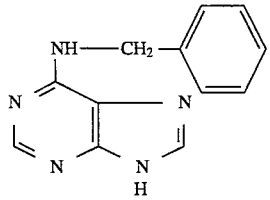

S-4

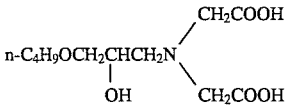

(Preparation of Backing Layer Protective Layer Coating Solution)

To an aqueous solution containing gelatin in an amount of 0.7 g per $m^2$, the following materials were added and stirred; namely, S-1 in an amount of 7 mg, a dispersion of monodisperse type polymethyl methacrylate having an average particle size of 5.5 μm, a mixture of [A], [B] and [C], and a styrene-maleic acid polymer. The following materials were then added thereto, namely, glyoxal as a layer hardener and sodium salt of 4-dichloro-6-hydroxy-1,3,5-triazine.

(Preparation of Sample)

One side of a polyethylene terephthalate film support having the foregoing antistatic layer was corona-discharged with an energy of 15 W/($m^2$.min.). Then, the backing layer coating solution and backing layer protective layer coating solution each prepared as mentioned above were coated on the side of the support whereto the antistatic layer was arranged. Also, an emulsion layer and an emulsion layer protective layer were coated on the side of the support whereto the corona-discharged with an energy of 15 W/($m^2$.min.). The emulsion layer was coated and dried up so that the silver content and gelatin content could be in the proportions of 4.0 mg/$m^2$ and 1.7 mg/$m^2$, respectively.

The resulting sample was processed by making use of the following developing solution and fixing solution through an automatic processor, Model GQ.26SR (manufactured by Konica Corp.), under the following conditions.

<Processing Conditions>
The processing conditions were as follows.

| Composition of Developing Solution | |
|---|---|
| (Sub-Composition A) | |
| Pure water | 150 ml |
| Disodium ethylenediamine tetraacetate | 2 g |
| Diethylene glycol | 50 g |
| Potassium sulfite (in an aqueous 55% W/V solution) | 130 ml |
| Potassium carbonate | 50 g |
| Hydroquinone | 15 g |
| 5-methylbenzotriazole | 200 mg |
| Compound of the invention or the comparative compound (See Table 1) | $1.0\times10^{-3}$ mols |
| Potassium hydroxide | An amount to make the pH of the solution used to be 10.5 |
| Potassium bromide | 4.5 g |
| (Sub-Composition B) | |
| Pure water | 3 ml |
| Diethylene glycol | 50 g |
| Disodium ethylene diamine tetraacetate | 25 mg |
| Acetic acid (in an aqueous 90% solution) | 0.3 ml |
| 5-nitroindazole | 110 mg |
| 1-phenyl-3-pyrazolidone | 500 mg |
| Before making use of the developing solution, the sub-compositions A and B were dissolved in this order to 500 ml of water so as to make | 1 liter |
| Composition of Fixing Solution | |
| (Sub-composition A) | |
| Ammonium thiosulfate (in an aqueous 72.5% W/V solution) | 230 ml |
| Sodium sulfite | 9.5 g |
| Sodium acetate.trihydrate | 28 g |
| Boric acid | 6.7 g |
| Sodium citrate.dihydrate | 2 g |

-continued

| <Processing Conditions> The processing conditions were as follows. | |
|---|---|
| Acetic acid (in an aqueous 90% W/W solution) | An amount to make the pH of the solution used to be 4.7 |
| (Sub-composition B) | |
| Pure water | 17 ml |
| Sulfuric acid (in an aqueous 50% W/W solution) | 2.5 g |
| Aluminium sulfate (an aqueous 8.1% W/W solution in terms of $Al_2O_3$) | 21 g |
| Before making use of the developing solution, sub-compositions A and B were dissolved in this order to 500 ml of water so as to make | 1 liter |

Processing Conditions

The same as in Example 1

When replenishing the developing solution or fixing solution, the replenishers having the same composition as in the corresponding solution subject to be replenished were replenished while keeping the replenishing rates to be 250 cc/m$^2$ to the developing solution and to be 400 cc/m$^2$ to the fixing solution, so that 30 m$^2$ of a sample was processed.

Silver stains produced after completing the development, the developing rate, fixing rate and preservability of the developing solution were each evaluated in the same manners as in Example 1.

The results thereof will be shown in Table 3.

As is apparent from Table 3, Test Nos. 5 through 15 in which a developing solution prepared by adding a compound of the invention was proved that almost no development stain was produced, that both of the developing rate and fixing rate were not lowered, and that the preservability of the developing solution was excellent.

Example 4

The process was carried out in quite the same manner as in Example 3, except that the composition of the developing solution was replaced as follows.

| <Processing Conditions> | |
|---|---|
| [Composition of Developing Solution] | |
| Disodium ethylenediamine tetraacetate | 2 g |
| Diethylene glycol | 25 g |
| Potassium sulfite (in an aqueous 55% W/W solution) | 114 ml |
| Potassium carbonate | 55 g |
| Hydroquinone | 20 g |
| 5-methylbenzotriazole | 300 mg |
| Compound of the invention or the comparative compound (See Table 1) | $1.0 \times 10^{-3}$ mols |
| Potassium hydroxide | An amount to make the pH of the solution used to be 10.5 |
| Potassium bromide | 3.3 g |
| 1-phenyl-3-pyrazolidone | 750 mg |
| Dissolve to pure water to male | 1 liter |

TABLE 3

| Test | Compound contained in developer | Development stain | Developing rate | Fixing rate | Preserv-ability | Remarks |
|---|---|---|---|---|---|---|
| 1 | — | 1 | 100 | 100 | 1 | Comparison |
| 2 | Comparative compound a | 3 | 55 | 45 | 2 | Comparison |
| 3 | Comparative compound b | 4 | 65 | 100 | 2 | Comparison |
| 4 | Comparative compound c | 4 | 78 | 90 | 2 | Comparison |
| 5 | Exemplified compound (VIa-1) | 5 | 98 | 100 | 5 | Invention |
| 6 | Exemplified compound (VIa-4) | 5 | 98 | 100 | 5 | Invention |
| 7 | Exemplified compound (VIa-6) | 4 | 100 | 100 | 4 | Invention |
| 8 | Exemplified compound (VIa-8) | 5 | 100 | 100 | 5 | Invention |
| 9 | Exemplified compound (VIa-11) | 5 | 97 | 100 | 5 | Invention |
| 10 | Exemplified compound (VIb-1) | 4 | 98 | 100 | 4 | Invention |
| 11 | Exemplified compound (VIb-2) | 5 | 100 | 100 | 4 | Invention |
| 12 | Exemplified compound (VIb-7) | 5 | 100 | 100 | 4 | Invention |
| 13 | Exemplified compound (VIc-1) | 5 | 98 | 100 | 5 | Invention |
| 14 | Exemplified compound (VIc-2) | 5 | 100 | 100 | 5 | Invention |
| 15 | Exemplified compound (VIc-4) | 5 | 98 | 100 | 5 | Invention |

a: 1-phenyl-5-mercaptotetrazole,
b: Sodium 2-mercaptobenzimidazole-5-sulfonate, and
c: Bisphenyl acetic acid-2-disulfide

TABLE 4

| Test | Compound contained in developer | Development stain | Developing rate | Fixing rate | Preserv-ability | Remarks |
|---|---|---|---|---|---|---|
| 1 | — | 1 | 100 | 100 | 1 | Comparison |
| 2 | Comparative compound a | 3 | 60 | 47 | 2 | Comparison |
| 3 | Comparative compound b | 4 | 65 | 100 | 2 | Comparison |
| 4 | Comparative compound c | 4 | 73 | 92 | 2 | Comparison |
| 5 | Exemplified compound VII-1 | 4 | 95 | 98 | 5 | Invention |
| 6 | Exemplified compound VII-3 | 5 | 100 | 100 | 5 | Invention |
| 7 | Exemplified compound VII-6 | 5 | 100 | 100 | 4 | Invention |
| 8 | Exemplified compound VII-12 | 5 | 96 | 97 | 5 | Invention |
| 9 | Exemplified compound VII-15 | 5 | 98 | 100 | 5 | Invention |
| 10 | Exemplified compound VII-19 | 5 | 100 | 100 | 5 | Invention |
| 11 | Exemplified compound VII-31 | 5 | 98 | 100 | 4 | Invention |
| 12 | Exemplified compound VII-34 | 4 | 100 | 100 | 5 | Invention |
| 13 | Exemplified compound VII-35 | 5 | 100 | 100 | 5 | Invention |
| 14 | Exemplified compound VIII-2 | 5 | 100 | 100 | 4 | Invention |
| 15 | Exemplified compound VIII-4 | 4 | 97 | 98 | 5 | Invention |
| 16 | Exemplified compound VIII-5 | 5 | 100 | 100 | 5 | Invention |
| 17 | Exemplified compound VIII-9 | 5 | 98 | 100 | 5 | Invention |
| 18 | Exemplified compound VIII-16 | 5 | 100 | 100 | 5 | Invention |
| 19 | Exemplified compound VIII-17 | 4 | 100 | 100 | 5 | Invention |
| 20 | Exemplified compound VIII-21 | 5 | 95 | 97 | 5 | Invention |
| 21 | Exemplified compound VIII-24 | 5 | 100 | 100 | 4 | Inventim |
| 22 | Exemplified compound VIII-30 | 5 | 100 | 100 | 5 | Invention |

a: 1-phenyl-5-mercaptotetrazole,
b: Sodium 2-mercaptobenzimidazole, and
c: Bisphenyl acetic acid-2-disulfide As is apparent from Table 4, Test Nos. 5 through 22 in which a developing solution prepared by adding a compound of the invention was proved that almost no development stain was produced, that both of the developing rate and fixing rate were not lowered, and that the preservability of the developing solution was excellent.

What is claimed is:

1. A method for processing an imagewise exposed black-and-white negative silver halide photographic light-sensitive material comprising a support having provided thereon photographic layers including at least one silver halide emulsion layer, one of said photographic layers containing a hydrazine derivative, said method comprising;

developing said light-sensitive material with a developer comprising a black and white developing agent and a compound represented by Formula VI, said developer having a pH of less than 11.5;

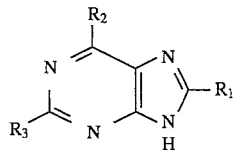

(VI)

wherein $R_1$, $R_2$, and $R_3$ are each independently hydrogen, —$SM_1$, hydroxyl, alkoxyl having 1 to 5 carbon atoms, —$COOM_2$, amino, alkyl having 1 to 5 carbon atoms, provided that at least one of $R_1$, $R_2$, and $R_3$ is —$SM_1$, and $M_1$ and $M_2$ are each independently hydrogen, alkali metal, or ammonium.

2. The method of claim 1 wherein the pH of said developer is not less than 9.5, and less than 11.5.

3. The method of claim 1 wherein said compound represented by Formula VI is contained in said developer, in an amount of $10^{-5}$ to $10^{-1}$ mols per liter of said developer.

4. The method of claim 1 wherein said compound represented by Formula VI is contained in said developer in an amount of $10^{-4}$ to $10^{-2}$ mols per liter of said developer.

5. The method of claim 1 wherein said compound represented by Formula VI is represented by Formula VIa;

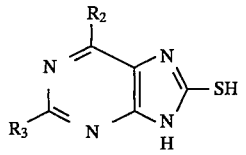

(VIa)

wherein $R_2$ and $R_3$ are the same as defined in Formula VI.

6. The method of claim 5 wherein said compound is selected from the group consisting of compounds represented by Formulas VIa-1 to VIa-16;

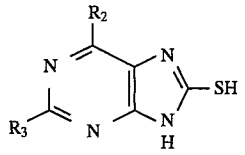

| | $R_2$ | $R_3$ |
|---|---|---|
| VIa-1 | H | H |
| VIa-2 | −OH | H |
| VIa-3 | H | −OH |
| VIa-4 | −SH | H |
| VIa-5 | H | −SH |
| VIa-6 | $-NH_2$ | H |
| VIa-7 | H | $-NH_2$ |
| VIa-8 | −OH | −OH |
| VIa-9 | $-NH_2$ | $-NH_2$ |
| VIa-10 | −SH | −SH |
| VIa-11 | $-CH_3$ | H |
| VIa-12 | H | $-CH_3$ |
| VIa-13 | $-CH_3$ | $-CH_3$ |
| VIa-14 | −COOH | H |
| VIa-15 | | |
| VIa-16 | $-OCH_3$ | H. |

7. The method of claim 1 wherein said compound represented by Formula VI is represented by Formula VIb;

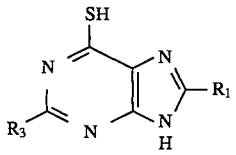

(VIb)

wherein $R_1$ and $R_3$ are the same as defined in Formula VI.

8. The method of claim 7 wherein said compound is selected from the group consisting of compounds represented by Formulas VIb-1 to VIb-12;

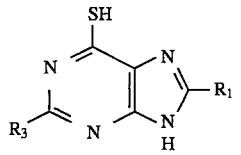

| | $R_1$ | $R_3$ |
|---|---|---|
| VIb-1 | H | H |
| VIb-2 | −OH | H |
| VIb-3 | H | −OH |
| VIb-4 | −OH | −OH |
| VIb-5 | $-CH_3$ | $-CH_3$ |
| VIb-6 | H | −SH |
| VIb-7 | $-NH_2$ | H |
| VIb-8 | H | $-NH_2$ |
| VIb-9 | $-CH_3$ | −OH |

-continued

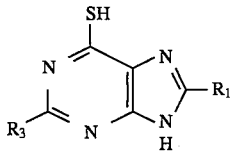

| | $R_1$ | $R_3$ |
|---|---|---|
| VIb-10 | $-CH_3$ | $-NH_2$ |
| VIb-11 | −SH | −OH |
| VIb-12 | $-NH_2$ | −SH. |

9. The method of claim 1 wherein said derivative of Formula VI is represented by Formula VIc;

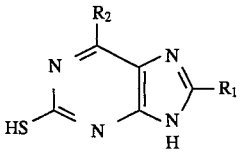

(VIc)

wherein $R_1$ and $R_2$ are each the same as $R_1$ and $R_2$ defined in Formula VI.

10. The method of claim 9 wherein said compound is selected from the group consisting of compounds represented by Formula VIc-1 to VIc-10;

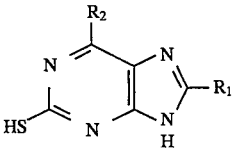

| | $R_2$ | $R_1$ |
|---|---|---|
| VIc-1 | H | H |
| VIc-2 | −OH | H |
| VIc-3 | H | −OH |
| VIc-4 | −OH | $-CH_3$ |
| VIc-5 | $-CH_3$ | −OH |
| VIc-6 | OH | −OH |
| VIc-7 | $-NH_2$ | H |
| VIc-8 | H | $-NH_2$ |
| VIc-9 | −COOH | H |
| VIc-10 | $-OCH_3$ | H. |

11. The method of claim 1 wherein said hydrazine derivative is a compound represented by Formula H-a or Formula H-b

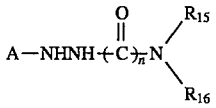

(H-a)

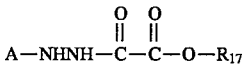

(H-b)

wherein A is aryl or a heterocyclic containing sulfur or oxygen; n is an integer of 1 or 2, provided that when n is 1, $R_{15}$ and $R_{16}$ are each independently hydrogen, alkyl, alkenyl, alkynyl, aryl, heterocyclic, hydroxyl, alkoxy, alkenyloxy, alkynyloxy, aryloxy, or heterocyclic-oxy, $R_{15}$ and $R_{16}$ may form a ring together with the nitrogen atom; when n is 2, $R_{15}$ and $R_{16}$ are each independently hydrogen, alkyl, atkenyl, alkynyl, aryl, saturated or unsaturated heterocyclic, hydroxyl, alkoxy, alkenyloxy, alkynyloxy, aryloxy, or heterocyclic-oxy, provided that at least one of $R_{15}$ and $R_{16}$ is alkenyl, alkynyl, saturated or unsaturated heterocyclic, hydroxyl, alkoxy, alkenyloxy, alkynyl, aryloxy, or heterocyclic-oxy; and $R_{17}$ is alkynyl or a saturated heterocyclic.

12. The method of claim 1 wherein said hydrazine derivative is a compound represented by Formula H-a, in which n is 2, or Formula H-b.

13. The method of claim 12 wherein said hydrazine derivative is a compound represented by Formula H-a in which n is 2.

14. The method of claim 1 wherein said hydrazine derivative is contained in said silver halide emulsion layer, or in a layer adjacent to said emulsion layer.

15. The method of claim 1 wherein said photographic layers include a silver halide emulsion layer containing said hydrazine derivative in an amount of $10^{-5}$ to $10^{-2}$ mols per mol of silver contained in said emulsion layer.

16. The method of claim 1 wherein silver halide grains used to form said silver halide emulsion layer have an average silver chloride content of not less than 50 mol %.

17. The method of claim 1 wherein said developing step is carried out while supplying a developer replenisher in an amount of 75 ml to 200 ml/$m^2$ of developed light-sensitive material.

18. The method of claim 1 wherein said light-sensitive material is fixed with a fixing solution having a pH of 3.8 to 5.8, after developing.

19. The method of claim 1 wherein total processing time is 20 to 60 seconds.

* * * * *